United States Patent [19]

Perun et al.

[11] Patent Number: 4,496,144

[45] Date of Patent: Jan. 29, 1985

[54] PADDLE WHEEL FEEDER WITH NORMAL FORCE OPTIMIZATION AND BLADE CONTROL

[75] Inventors: William D. Perun, Webster; Gerald M. Garavuso, Macedon, both of N.Y.

[73] Assignee: Xerox Corporation, Stamford, Conn.

[21] Appl. No.: 409,392

[22] Filed: Aug. 19, 1982

[51] Int. Cl.[3] ..... B65H 3/06

[52] U.S. Cl. ..... 271/114; 221/259; 271/120; 271/266

[58] Field of Search ..... 271/120, 119, 114, 115, 271/116, 266; 221/259

[56] References Cited

U.S. PATENT DOCUMENTS

| | | | |
|---|---|---|---|
| 985,592 | 2/1911 | Hodgkinson | 271/120 |
| 2,869,869 | 1/1959 | Bauer | 271/114 |
| 3,612,514 | 10/1971 | Schweihs | 271/266 |
| 3,630,516 | 12/1971 | Hong | 271/36 |
| 4,045,015 | 8/1977 | Sardella | 271/112 |
| 4,126,305 | 11/1978 | Colgiazier et al. | 271/120 |

FOREIGN PATENT DOCUMENTS 2034670A 6/1980 United Kingdom

*Primary Examiner*—Bruce H. Stoner, Jr.
*Assistant Examiner*—John A. Carroll
*Attorney, Agent, or Firm*—William A. Henry, II

[57] ABSTRACT

A paddle wheel feeder includes a paddle wheel having a foam hub with at least three blades molded therein. The paddle wheel is mounted to be rotatably driven by a shaft having a Geneva mechanism attached thereto which causes the paddle wheel to stop just before one of the blades contacts the top sheet in a stack and then accelerate to drive the sheet forward. For normal force optimization, internal springs are located inside each paddle of the wheel is one embodiment and a thick bladed foam paddle wheel is utilized in another embodiment with each blade having a coating of high friction material.

7 Claims, 4 Drawing Figures

PADDLE WHEEL FEEDER WITH NORMAL FORCE OPTIMIZATION AND BLADE CONTROL

BACKGROUND OF THE INVENTION

This invention relates generally to an electrophotographic printing machine, and more particularly, concerns a paddle wheel sheet feeding system for feeding sheets from a stack along a predetermined path.

Many of the prior art paddle wheel sheet feeding mechanisms occasionally malfunction, feeding more than one sheet at a time or failing to feed a sheet on demand. Consequently, the search has continued for a more consistent and reliable feeder mechanism.

One of the problems with existing feeders that employ paddle wheel separation is that they develop normal force as a result of impacting the copy sheets and by progressive bending of the paddle wheel blades during the sweep through their arc of contact. The paddle wheel blades are usually thin and produce unstable vibrations at certain revolutions per minute causing a large impulse when they first strike the sheets and generate an increasing normal force during their arc of contact.

The large impulse generated by the blades of the paddle wheel striking the sheets at the beginning of their arc of contact can actually stop the oncoming sheet, drive it backwards, stop it again and subsequently drive it forward. This reverse movement phenomena is a function of blade vibration, revolutions per minute and intersheet drag.

Numerous devices such as impact/paddle feeders of the type disclosed in U.S. Pat. No. 3,630,516 have been employed to minimize the possibility of misfeeds or multifeeds due to the above-mentioned problems.

The aforementioned impact feeders or "inertia feeders" have been employed in top sheet feed devices in an attempt to overcome intersheet friction and assure positive feeding of sheets by jarring or impacting the sheet to be fed from the adjacent sheets. However, in impacting sheets, there is a tendency for the impacting device to jam the sheet to be fed into tighter engagement with the remainder of the sheets in the stack, thereby obviating the benefits obtained in attempting to impact the sheet in the feed direction, off from the remainder of the sheets in the stack. As an improvement, the present top feeder uses an intermittent motion of the paddle wheel, followed by a period of no motion whereby a blade is positioned just at the top sheet surface, followed by a large acceleration with the friction drive force directed as close to parallel to the top sheet surface as possible, followed by an up and away motion from the sheet stack and a relatively constant normal force profile with no impulse spike at the beginning of the arc of contact. This uniform normal force is substantially independent of paddle wheel blade penetration into the top sheet in the stack.

SUMMARY OF THE INVENTION

Accordingly, in an aspect of the invention, a paddle wheel sheet feeder comprises a foam roll paddle wheel with a plurality of blades molded therein. The paddle wheel is mounted on a shaft that also has a Geneva mechanism attached. The Geneva mechanism causes controlled intermittent motion of the paddle wheel such that as the paddle wheel starts into its arc of contact with the top sheet in a stack, normal force is generated primarily through compression of the individual blades.

BRIEF DESCRIPTION OF THE DRAWINGS

Other objects and advantages of the present invention will become apparent upon reading the following detailed description and upon reference to the drawings, in which.

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
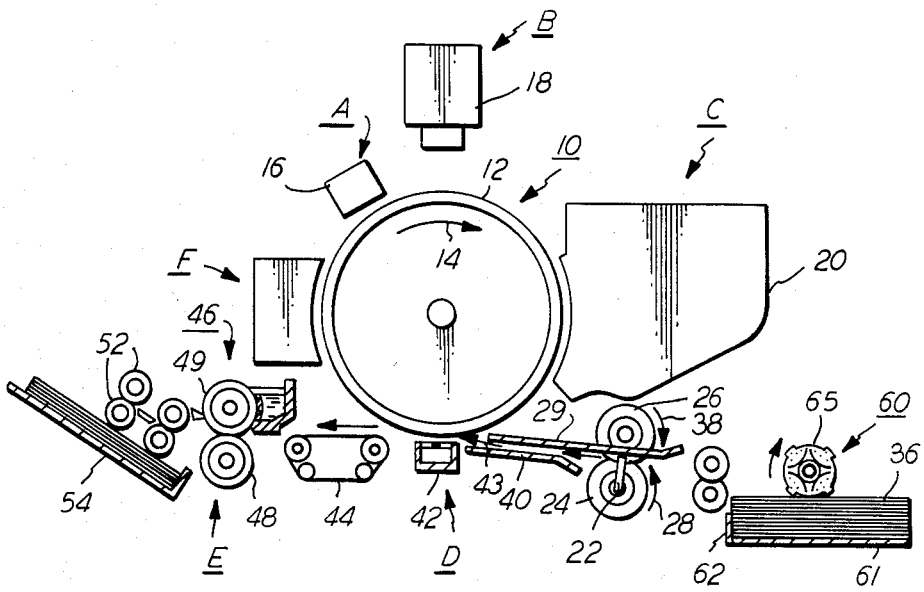
FIG. 1 is a schematic elevational view of an electrophotographic printing machine incorporating the features of one aspect of the present invention.

For a general understanding of an electrophotographic printing machine in which the features of the present invention may be incorporated, reference is made to FIG. 1 which depicts schematically the various components thereof. Hereinafter, like reference numerals will be employed throughout to designate identical elements. Although the apparatus for forwarding sheets along a predetermined path is particularly well adapted for use in the electrophotographic printing machine of FIG. 1, it should become evident from the following discussion that it is equally well suited for use in a wide variety of devices and is not necessarily limited in its application to the particular embodiment shown herein. For example, the apparatus of the present invention will be described hereinafter with reference to feeding successive copy sheets, however, one skilled in the art, will appreciate that it may also be employed for feeding successive original documents.

Since the practice of electrophotographic printing is well known in the art, the various processing stations for producing a copy of an original document are represented in FIG. 1 schematically. Each processing station will be briefly described hereinafter.

As in all electrophotographic printing machines of the type illustrated, a drum 10 having a photoconductive surface 12 entrained about and secured to the exterior circumferential surface of a conductive substrate is rotated in the direction of arrow 14 through the various processing stations. By way of example, photoconductive surface 12 may be made from selenium of the type described in U.S. Pat. No. 2,970,906 issued to Bixby in 1961. A suitable conductive substrate is made from aluminum.

Initially, drum 10 rotates a portion of photoconductive surface 12 through charging station A. Charging station A employs a corona generating device, indicated generally by the reference numeral 16, to charge photoconductive surface 12 to a relatively high substantially uniform potential. A suitable corona generating device is described in U.S. Pat. No. 2,836,725 issued to Vyverberg in 1958.

Thereafter drum 10 rotates the charged portion of photoconductive surface 12 to expose station B. Exposure station B includes an exposure mechanism, indicated generally by the reference numeral 18, having a stationary, transparent platen, such as a glass plate or the like for supporting an original document thereon. Lamps illuminate the original document. Scanning of the original document is achieved by oscillating a mirror in a timed relationship with the movement of drum 10 or by translating the lamps and lens across the original document so as to create incremental light images which are projected through an apertured slit onto the charged portion of photoconductive surface 12. Irradiation of the charged portion of photoconductive surface 12 records an electrostatic latent image corresponding to the informational areas contained within the original document.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on photoconductive surface 12.

With continued reference to FIG. 1, a copy sheet is advanced by sheet feeding apparatus 60 to transfer station D. Sheet feeding apparatus 60 advances successive copy sheets to registration rollers 24 and 26. Registration roller 24 is driven by a motor (not shown) in the direction of arrow 28 and idler roller 26 rotates in the direction of arrow 38 since roller 24 is in contact therewith. In operation, feed device 60 operates to advance the uppermost sheet from stack 36 into registration rollers 24 and 26 and against registration fingers 22. Fingers 22 are actuated by conventional means in timed relation to an image on drum 12 such that the sheet resting against the fingers is forwarded toward the drum in synchronism with the image on the drum. The sheet is advanced in the direction of arrow 43 through a chute formed by guides 29 and 40 to transfer station D. The detailed structure of a conventional registration control system such as rollers 24 and 26 is described in U.S. Pat. No. 3,902,715 which is incorporated herein by reference to the extent necessary to practice the invention.

Continuing now with the various processing stations, transfer station D includes a corona generating device 42 which applies a spray of ions to the back side of the copy sheet. This attracts the toner powder image from photoconductive surface 12 to the copy sheet.

After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 48 and a backup roll 49 defining a nip therebetween through which the copy sheet passes. After the fusing process is completed, the copy sheet is advanced by rollers 52, which may be of the same type as registration rollers 24 and 26, to catch tray 54.

Invariably, after the copy sheet is separated from photoconductive surface 12, some residual toner particles remain adhering thereto. These toner particles are removed from photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 2 depicts the top feeder system in greater detail.

Figure 2:
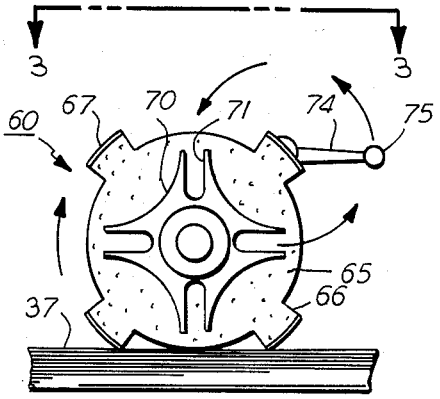
FIG. 2 is an enlarged partial side view of the intermittently driven paddle wheel feeder shown in FIG. 1.

Referring now to FIG. 2, the detailed structure and operation of the present feeder system 60 will be described. Sheets 37 are shown stacked on platform 61 that has a sheet restraining wall 62 attached thereto. Paddle wheel 65 is molded from foam material which may have high friction, low wear contact pads 67 attached and is rotated by conventional means to bring thicker than normal blades 66 into contact with sheet stack 36. Normally, paddle wheel separators produce a normal force spike or impulse that has a negative effect on sheet displacement. In contrast, paddle wheel feeder 60 reduces this impulse and provides an acceleration to the normal force and resulting frictional drive force. The normal force through the sweep of the blades 66 is less peaked and thereby provides a substantially consistent drive force which will cause fewer multifeeds. This reduction in impulse and acceleration increase in paddle wheel blades 66 is obtained through the use of Geneva mechanism 70 that is mounted on the same shaft as paddle wheel 65. The Geneva mechanism causes controlled intermittent motion of the paddles.

Figure 3:
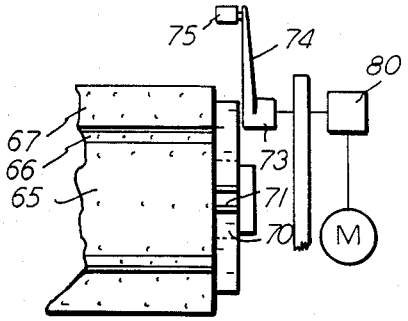
FIG. 3 is an enlarged partial front view of the paddle wheel and Geneva mechanism employed in the feeder of FIG. 1.

As seen in FIG. 3, conventional motor M, which is actuated when paper feeding is required, is connected to a conventional clutch 80 that in turn is connected to crankshaft 73. Crankshaft 73 has a crankarm 74 attached thereto. An engaging pin 75 is drivingly attached to crankarm 74 so that as crankshaft 73 is rotated as a result of solenoid actuated wrap spring clutch 80 becoming actuated, engaging pin 75 will ride into channel 71 of Geneva mechanism 70 and thereby cause rotation of paddle wheel 65. By nature of the clutch operation, the paddle wheel always stops in one of the prescribed positions of the Geneva Mechanism when the clutch is deactuated, which positions in this case is four. As the blades 66 start into their arc of contact, the normal force is generated primarily through compression of the blades. Existing paddle wheel devices develop their normal force primarily through bending. As a conventional paddle makes contact with a sheet in a stack, the normal force increases and the paddle tends to provide an excessive drive force through the top sheet and to the next sheet thus propagating multiple sheet movement and multifeeds.

The maximum angular acceleration of the paddles or blades 66 in FIG. 3 occurs when pin 75 has advanced about 30% into the channel 71. The angular displacement, velocity and acceleration of the paddle wheel blade tips can be described with certainty when the normal force is generated by compression rather than bending. Also, because the blades 66 have large bending stiffness they will not vibrate once they leave the copy sheet.

The normal force profile for conventional paddle wheels can be made relatively constant by increasing the length to thickness ratio of the blades which not only maintains a consistent normal force but also reduces the net normal force for a particular blade thickness. The resulting blades are longer, and therefore, the overall package height increases. Contrawise, the normal force generated by the paddle wheel of FIGS. 1 and 2 is caused substantially by compression and only a small amount of bending. The normal force will be generated primarily by the KX expression where X is the amount of compression and K is the spring constant of the blade material. Compressive characteristics are separated from friction and wear by use of different materials.

In operation, the paddle wheel is actuated into intermittent motion. The Geneva mechanism causes the paddle wheel to stop at a position where one of the blades of the paddle wheel is almost touching the top sheet in the stack of sheets to be fed. There is a period of no motion as the engaging pin 75 is rotated. The blade adjacent the top sheet in the stack is subsequently accelerated, due to continued rotation of the engaging pin, into engagement with the top sheet in the stack with the result of friction and normal forces of the blade being directed as close to parallel to the top sheet as possible. After contacting the top sheet in the stack, the blade is immediately moved up and away from the stack. Even though a foam paddle wheel with thick blades is described in the preferred embodiment of the present invention, a standard or convention paddle wheel with thin blades could also be used due to the employment of a Geneva mechanism as an intermittent driving means. The incrementing rotation of the paddle wheel brought about by the Geneva mechanism provides dwell time for conventional paddle wheel blades to stabilize their vibration before the next sweep takes place.

Figure 4:
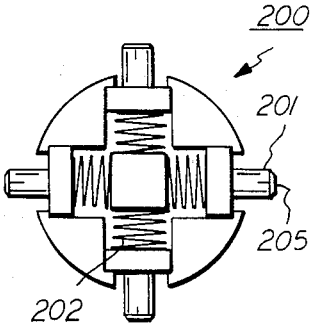
FIG. 4 is an enlarged partial side view of another embodiment of the present invention which could be employed in the printing system shown schematically in FIG. 1.

In FIG. 4, an alternative embodiment of the present invention for normal force optimization is shown as paddle wheel 200 in which the normal force profile as a result of compression is optimized by the use of spring contolled blades 201. The springs 202 apply the desired amount of pressure of blades 201 as the blades strike the top sheet in a stack. The sweep of the blades across the stack will cause the springs to compress at a controlled rate and apply a substantially uniform pressure to the sheet stack. Tip 205 is the frictional drive material for blades 201.

In both embodiments, the paddle wheel surface that contacts the paper can be profiled to match that of the long term worn in profile by molding in the desired profile. Further, the normal force function and the elastomer to paper coefficient of friction function can be optimized separately. That is, the foam paddle wheel material can be used to generate the normal force as it is compressed while the surface of the paddle wheel can be coated with a high coefficient of friction material. In the embodiment of FIG. 4, the spring provides the normal force while the friction drive material provides the necessary coefficient of friction between the blade and paper.

In conclusion, according to the present invention, a paddle wheel feeder is disclosed which has normal force optimization capabilities. The feeder paddle wheel is intermittently driven by the use of a Geneva mechanism. The Geneva mechanism causes the rotation of the paddle wheel to stop just before a blade contacts a stack of sheets and then accelerate to drive the top sheet in the stack forward. Normal force optimization in one aspect of the invention is obtained by the use of resilient contact blades and internal control rate springs.

It is, therefore, evident that there has been provided in accordance with the present invention a paper feeding system which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A paddle wheel feeder adapted to feed sheets seriatim from a stack of sheets with a diminished normal force spike, comprising:

support means for supporting a stack of sheets to be fed;

paddle wheel means supported on a shaft and having a plurality of blades positioned to sweep the top of said stack of sheets and feed sheets individually therefrom; and control means adapted to reduce the normal force spike resulting from individual blades striking the top sheet in said stack of sheets, said control means including means for incrementally rotating said paddle wheel means to a position where each blade is immediately adjacent the top sheet in said stack of sheets, stopping the rotation momentarily as each blade of said paddle wheel means is in said position and then continuing the rotation such that the normal force produced by the sweep of said plurality of blades across said stack of sheets is less peaked and thereby reducing multifeeding of sheets.

2. The paddle wheel feeder of claim 1, wherein said control means is a Geneva mechanism mounted on said shaft.

3. The paddle wheel feeder of claim 2, wherein said paddle wheel means is a foam member.

4. The paddle wheel feeder of claim 1, wherein the normal force generated by said paddle wheel means is caused substantially by compression.

5. The paddle wheel feeder of claim 4, wherein said plurality of blades are individually spring loaded within a housing such that the sweep of the blades across said stack of sheets will cause the springs to compress at a controlled rate and apply a substantially uniform and predictable pressure to said stack of sheets.

6. The paddle wheel feeder of claim 5, wherein said housing has a central core and said springs are positioned between said central core and plurality of blades.

7. The paddle wheel feeder of claim 1, wherein said control means includes a series of positions for stopping rotation of said paddle wheel means during one complete revolution of said paddle wheel means.

* * * * *